United States Patent [19]

Hill et al.

[11] 4,260,384

[45] Apr. 7, 1981

[54] OBSCURATION DEVICE FOR TANK GUNNERS

[75] Inventors: Garnett L. Hill, E. Town; Antal T. Molnar; Henry I. Jehan, Jr., both of Radcliff, all of Ky.

[73] Assignee: The United States of America as represented by the Secretary of the Army, Washington, D.C.

[21] Appl. No.: 56,159

[22] Filed: Jul. 10, 1979

[51] Int. Cl.[3] ..... F41F 27/00

[52] U.S. Cl. ..... 434/16

[58] Field of Search ..... 35/25, 12 G, 12 N; 273/310, 313

[56] References Cited

U.S. PATENT DOCUMENTS

| | | | |
|---|---|---|---|
| 1,376,357 | 4/1921 | Place | 273/310 X |
| 3,272,510 | 9/1966 | Ohlund et al. | 35/25 UX |
| 3,452,453 | 7/1969 | Ohlund | 35/25 |
| 3,820,253 | 6/1974 | Willey | 35/25 |

OTHER PUBLICATIONS

*Electronics* Magazine, Jun. 1976, p. 53, "French Simulator Trains Tank Gunners".

*Primary Examiner*—William H. Grieb
*Attorney, Agent, or Firm*—William G. Gapcynski; Werten F. W. Bellamy; Arthur I. Spechler

[57] ABSTRACT

A tank gunner obscuration device is provided for automatically and selectively obscuring the view out of the tank seen by the gunner in response to the firing of the main gun of the tank so as to simulate the obscuration produced by smoke, heat and debris during an actual firing. The device comprises a movable shutter which is automatically pivoted between a blocking and unblocking position responsive to firing of the main gun. The control mechanism for the shutter includes an operating solenoid energized by an electrical timer which controls the duration of the obscuration provided. A series of replaceable panels, which are removably mounted in the shutter frame and provide different degrees of opacity, enable the amount of obscuration to be varied.

7 Claims, 5 Drawing Figures

OBSCURATION DEVICE FOR TANK GUNNERS

FIELD OF THE INVENTION

The present invention relates to a device for automatically obscuring the viewing sight of a tank gunner responsive to the firing of the main gun of the tank so as to simulate the blast effect of the gun.

BACKGROUND OF THE INVENTION

When the main gun of a tank is fired, the smoke, heat and debris exiting from the muzzle of the gun form a cloud that obscures the ability of the gunner to see the target. Depending on the surrounding climatic conditions, this obscuration can last for several seconds. In all cases, the time period during obscuration is long enough that the gunner will not be able to see the immediate impact of the round he has fired.

In training gunners, it is extremely costly to use live ammunition and because if this, a procedure known as "dry fire" is utilized wherein the gunner goes through all of the steps in firing without the expenditure of ammunition. This dry fire procedure is also used in training and testing where the target cannot be fired on for safety or economic reasons.

SUMMARY OF THE INVENTION

In accordance with the present invention, a tank gunner obscuration device is provided which automatically obscures the view out of the tank seen by the gunner in response to firing of the main gun of the tank. In this way, the view that would be seen by the gunner out of the main sight periscope exit window during actual firing conditions is simulated. In particular, the invention reproduces the obscuring of the gunner's view which accompanies the firing of the tank gun and which is the result of the smoke, heat and debris produced when the gun is fired. Thus, so-called dry fire training is considerably more realistic than would be the case with prior art training techniques.

According to a preferred embodiment thereof, the obscuration device of the invention comprises a pivotable shutter which is moved between a blocking and unblocking position responsive to the firing of the main gun. An electrical control circuit sets the blocking time and controls energization of a solenoid which provides movement of the shutter.

In order to provide different degrees of obscuration, the shutter is provided with removable panels of different opacity which are removably inserted into the shutter frame.

The electrical control circuit includes a timed relay that controls the blocking time of the shutter and which, when energized, generates a trigger signal for activating the control solenoid. Relay controlled contacts provide for connecting a sustaining voltage to the relay as well as generating the trigger signal. An indicator light is energized by the trigger signal and a diode connected between the input leads to a cable connection to the solenoid limits negative field excursions of the solenoid.

The solenoid preferably comprises a rotary solenoid and the operating mechanism for the shutter converts the rotary motion of the solenoid output shaft into pivoting movement of the shutter. This operating mechanism includes a link pivotably mounted on a post at a point intermediate the ends of the link and connected between the solenoid and the shutter frame.

Other features and advantages of the invention will be set forth in, or apparent from, the detailed description of the preferred embodiment found hereinbelow.

DESCRIPTION OF THE PREFERRED EMBODIMENTS

Figure 1:
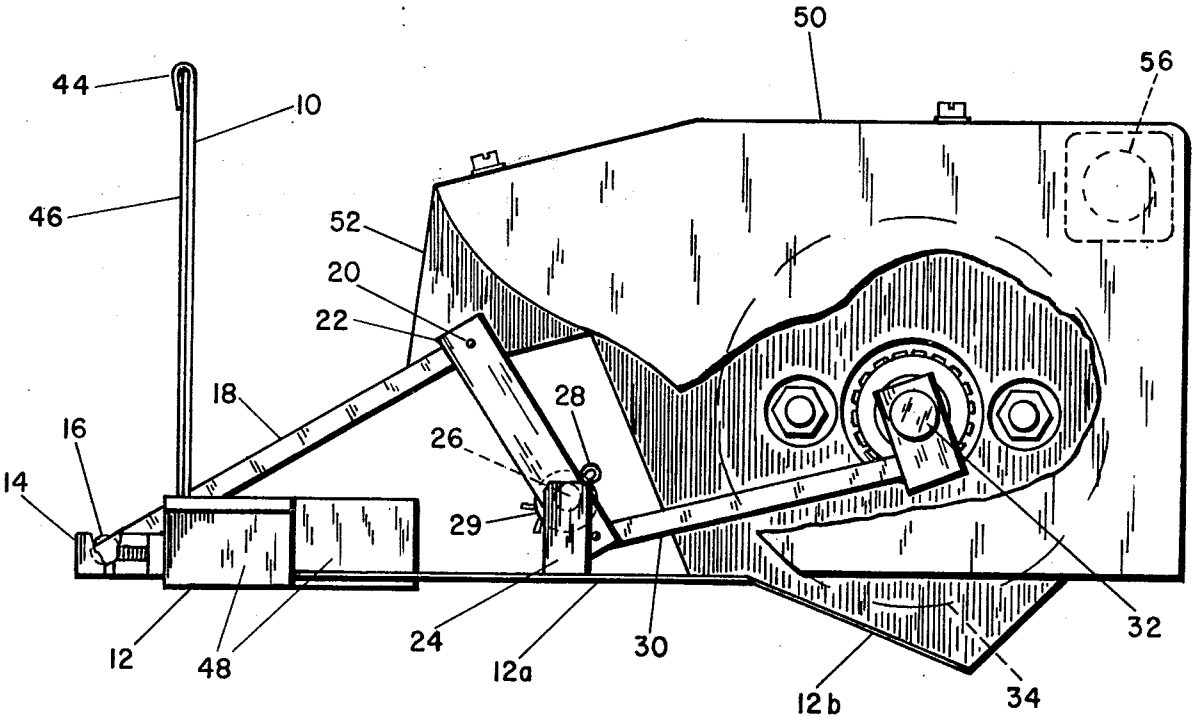
FIG. 1 is an end view of the mechanical portion of an obscuration shutter mechanism in accordance with a preferred embodiment of the invention.
Figure 2:
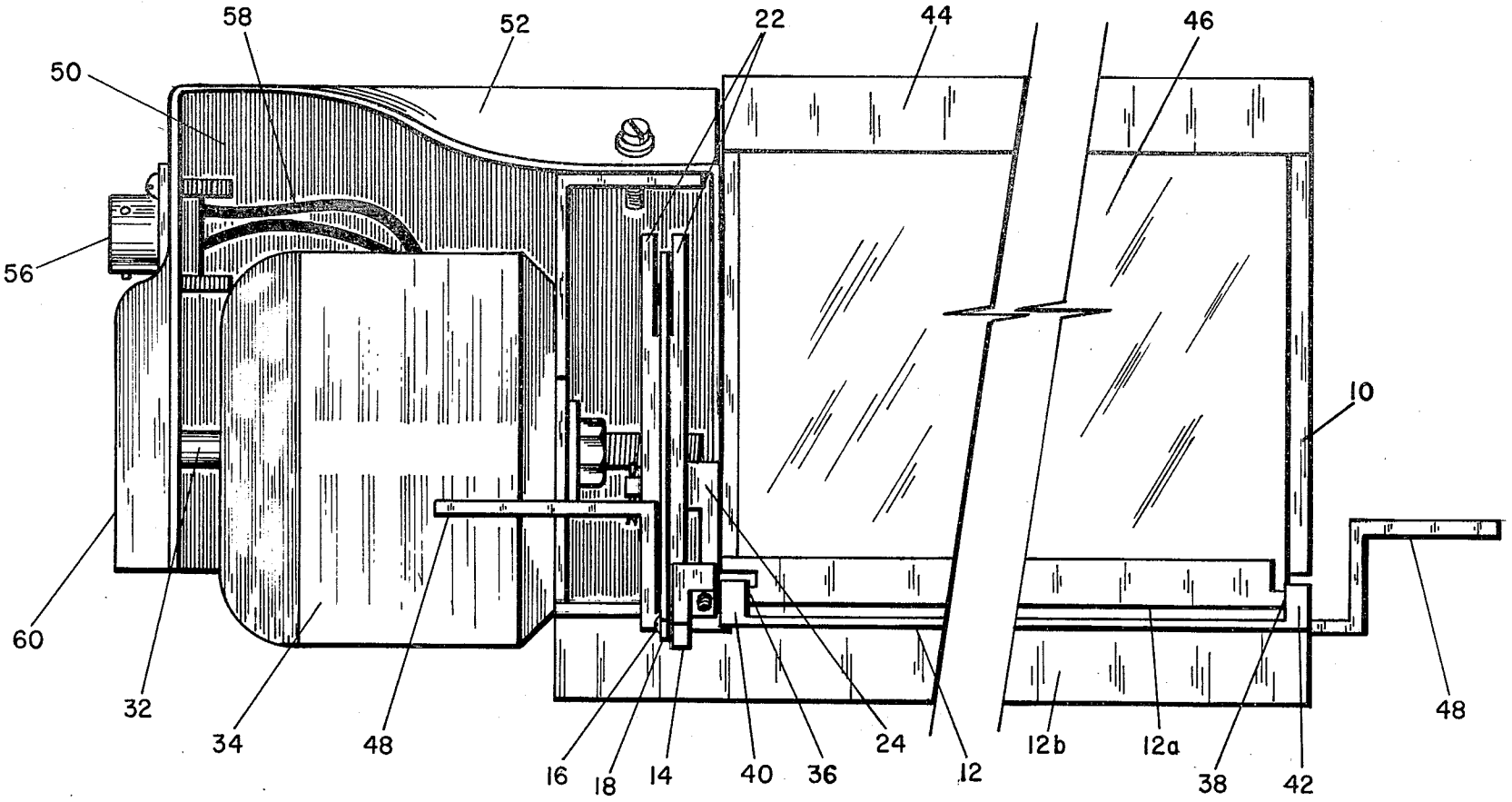
FIG. 2 is a rear view of the shutter mechanism of FIG. 1.

Referring to FIGS. 1 and 2, an end elevational and front view are provided which illustrate a preferred embodiment of the solenoid-operated mechanical shutter portion of the invention, FIG. 1 showing the shutter in the up position and FIG. 2 the down position. The shutter mechanism includes a shutter frame 10 which is pivotably mounted with respect to a base plate 12.

Figure 3:
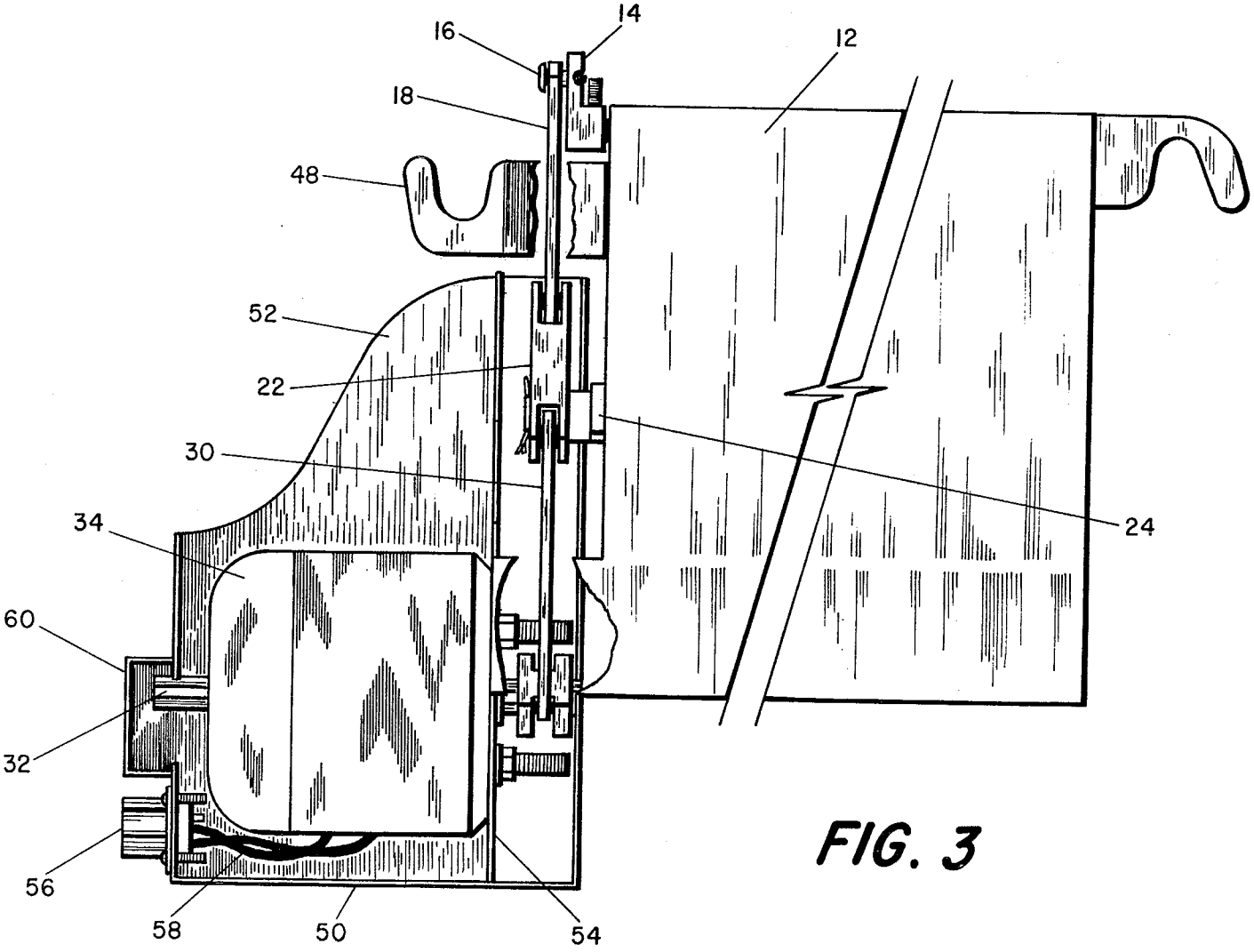
FIG. 3 is a bottom view of a portion of the shutter mechanism of FIG. 1.

As shown in FIGS. 1 and 3, the mounting arrangement includes a pivot control arm 14 which is fixedly secured to one end of shutter frame 10 as described below. A screw 16 provides for connection of the pivot control arm 14 to an operating link 18, screw 16 extending through a hole in one end of link 18. The other end of link 18 is pinned by a pin 20 to a pair of spaced, parallel intermediate links 22 which are pivotably mounted on an upstanding pivot post 24 formed integrally with base plate 12 (see FIG. 1). Pivot post 24 supports a pivot rod 26 which extends through registering holes in links 22 which are located intermediate the ends thereof, the links 22 being mounted for rotation about the fixed pivot axis formed by pivot rod 26. A cotter pin 28 and washer 29 serve in holding links 22 in place on pivot rod 26. The other end of link 22 is pinned to a shutter activator arm or link 30 attached to the rotary drive shaft 32 of a solenoid 34 (see FIG. 3).

Shutter frame 10 includes a pair of pivot stubs or axles 36 and 38 located at opposite ends of the lower edge thereof, with pivot control arm 14 being fixedly secured to pivot axle 36. Axles 36, 38 are mounted for rotation in fixed housings 40 and 42 which are formed integrally with base plate 12. A resilient clip-like portion 44 located at the "top" or free end of shutter frame 10 enables panels 46 of different characteristics to be readily mounted on and removed from frame 10. As explained hereinabove, panels of different opacity can be used depending on the type of gun being fired, the time of day, etc., in order to provide the most realistic view for the gunner.

The base plate 12 includes a straight portion **12*a* and an inclined portion 12*b* and a pair of outwardly extending mounting brackets 48 are used in bolting the entire assembly to a tank or the like. In general, the shutter device is adapted to be mounted directly in front of the main sight periscope exit window, with the control unit, described below, being disposed inside the tank at any convenient location. Base 12 is preferably formed integrally with a solenoid housing 50 which houses solenoid 34 and which includes an outwardly extending portion 52 that overlies the operating mechanism for shutter frame 10 (see, e.g., FIG. 1). The housing also includes a solenoid mounting plate 54 (FIG. 3) which provides a mounting for solenoid 34. A three pin power connector 56 is secured to housing 50 and a pair of flexible lead wires 58 connect solenoid 34 to connector 56 and a shield portion 60 of housing 50 shields solenoid shaft 32. As explained hereinbelow, connector 56 is adapted to be connected to a control unit which controls energization of solenoid 34 and consequently, pivoting of shutter frame 10**.

Figure 4:
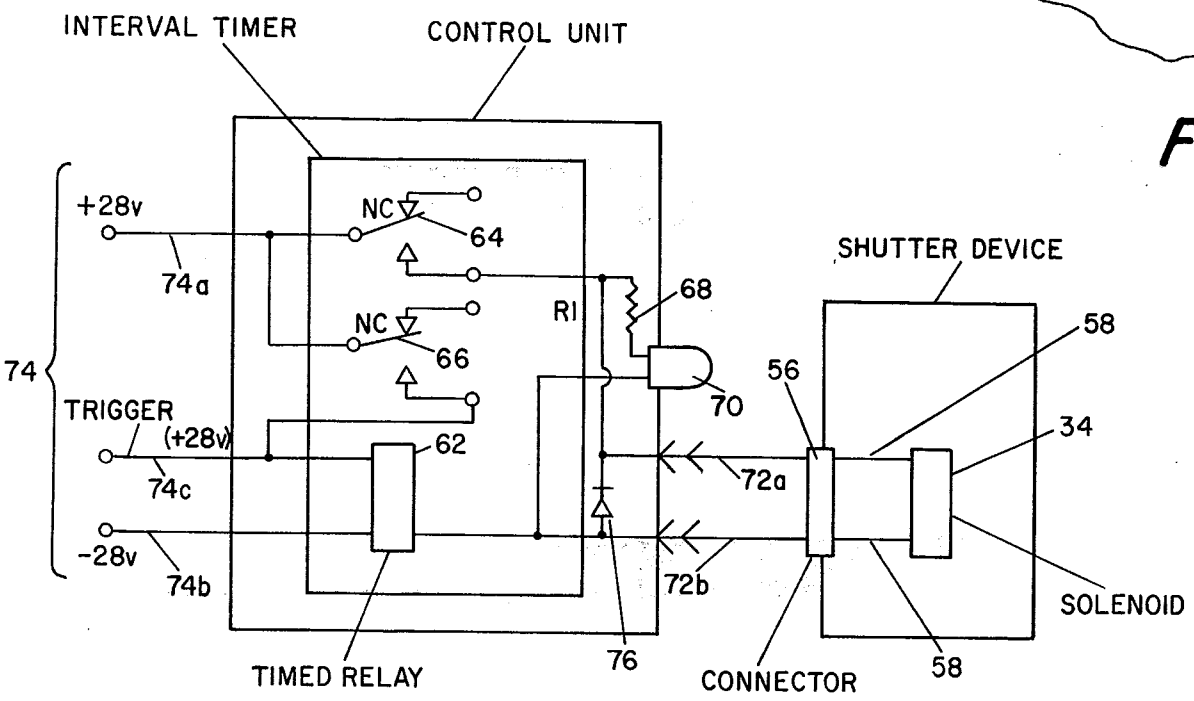
FIG. 4 is a schematic circuit diagram of the electrical control unit of the invention.

The control unit referred to above is shown in FIG. 4. The control unit includes timed relay or timer 62 which controls actuation of a pair of normally closed switches 64 and 66. Timer 62 can be set to provide timing interval of 1 to 10 seconds in the exemplary embodiment under consideration. Switch 66, when actuated, locks in a +28V supply for timer 62. Switch 64 is connected through a current limiting resistor 68 to a light emitting diode (LED) 70 and through a connector cable conductor **72*a* and lead 58 to rotary solenoid 34. A further connector cable, indicated at 74, is connected to the input of the control unit and provides a +28V supply voltage on conductor 74*a*, a −28V supply voltage on conductor 74*b* and a +28V trigger voltage on a third conductor 74*c*. Cable conductors 74*b* and 72*b* provide a −28V supply to solenoid 34. A diode 76 connected between conductors 72*a* and 72*b* limits negative field excursions of solenoid 34. The LED 70** permits an observer to determine the total time that the shutter is closed, i.e., the total time of obscuration, and provides a check on system operation.

Figure 5:
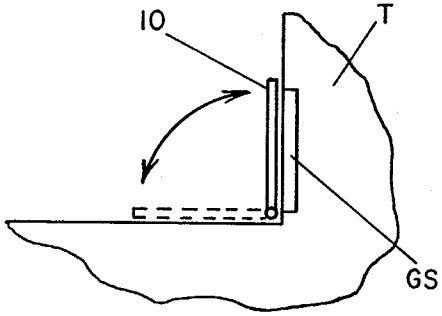
FIG. 5 is a highly schematic representation of a tank incorporating a shutter mechanism for blocking and unblocking the gunner's sight window.

In the operation of a shutter control system of the invention, a trigger signal is produced on line **74*c* when the gunner's trigger is depressed. A simple microswitch (not shown) actuated responsive to depressing of the trigger can be used to provide this trigger signal. The trigger signal energizes timer 62 which causes actuation of switches 64 and 66. As discussed above, actuation of switch 64 causes energization of rotary solenoid 34. Rotation of solenoid drive shaft 32 mechanically closes obscuration shutter 10 in a manner described in more detail below. As illustrated in FIG. 5, shutter 10, during closing, moves from the dashed line position to the solid line position so as to block the gunner's observation sight GS of tank T. At the end of timing period of timer 62, solenoid 34 is de-energized and the shutter 10** returns to the normal, lowered position thereof, thereby restoring the gunner's vision.

Considering the mechanical operating mechanism in more detail, rotation of solenoid drive shaft 32 causes pivoting of link arms 22 through the action of activator arm 30. Rotation of link arms 22 in a clockwise direction as viewed in FIG. 1 causes rightward movement of link 18 and consequent pivoting of pivot control arm 14 to a horizontal position, and frame 10 to a vertical position, as shown in FIG. 1. When solenoid 34 is de-energized, activator arm 30 is moved rightwardly to cause counterclockwise rotation of link arms 22. This exerts a pulling force on control arm 14 which moves the same to an upright position, thereby causing movement of frame 10 to the horizontal, non-blocking form position.

Although the invention has been described with respect to exemplary embodiments thereof, it will be understood that variations and modifications can be effected in the embodiments without departing from the scope or spirit of the invention.

We claim:

1. A tank gunner obscuration device for automatically and selectively obscuring the view out of the tank as seen by the tank gunner responsive to the firing of the main gun of the tank, said device comprising:

a. means for generating a trigger signal responsive to firing the main gun;

b. obscuration means responsive to said trigger signal for obscuring the view out of the tank for a predetermined time period subsequent to the firing of said gun; and c. said obscuration means comprising a movable shutter and means for moving said shutter between a first blocking position, wherein the view out of said tank is obscured, and a second rest position.

2. A device as claimed in claim 1 wherein said shutter comprises a shutter frame and a replaceable panel removably inserted in said frame whereby different degrees of obscuration can be provided by replacing said panel with different panels of differing opacity.

3. A device as claimed in claim 1 wherein said means for moving said panel comprising solenoid actuated by said trigger signal and a mechanical operating mechanism movable responsive to said solenoid for causing pivoting said shutter between said first and second positions.

4. A device as claimed in claim 3 wherein said solenoid comprises a rotary solenoid having an angularly movable drive shaft and said operating mechanism includes means, including a pivot post defining a fixed pivot axis and interconnecting links, for converting the rotary movement of said solenoid drive shaft into a pivoting movement of said shutter.

5. A device as claimed in claim 1 wherein said means generating a trigger signal includes an adjustable electrical timing means for setting said predetermined period.

6. A device as claimed in claim 5 wherein said obscuration means includes a control solenoid for controlling movement of said shutter and said timing means comprises a timed relay for controlling energization of said solenoid.

7. A device as claimed in claim 5 wherein said trigger signal generating means further comprises a pair of relay switches controlled by said timed relay, one of said switches, when actuated, providing a sustaining voltage for said relay, and the other of said switches providing a connection to said control solenoid, said trigger signal generating means including a cable connection to said solenoid, a diode being connected between the input conductors to said cable connection for limiting negative field excursions of the solenoid, and an indicating light being connected to said other switch.

* * * * *